US005628648A

United States Patent [19]

Higgins, Jr. et al.

[11] Patent Number: 5,628,648

[45] Date of Patent: May 13, 1997

[54] ELECTRICAL CONNECTOR POSITION ASSURANCE SYSTEM

[75] Inventors: John O. Higgins, Jr., Berwyn; Scott P. Marceau, Naperville, both of Ill.

[73] Assignee: Molex Incorporated, Lisle, Ill.

[21] Appl. No.: 407,130

[22] Filed: Mar. 17, 1995

[51] Int. Cl.[6] ..... H01R 3/00; H01R 13/62

[52] U.S. Cl. ..... 439/489; 439/372

[58] Field of Search ..... 439/352, 372, 439/310, 488, 489

[56] References Cited

U.S. PATENT DOCUMENTS

| | | | |
|---|---|---|---|
| 4,370,013 | 1/1983 | Niitsu et al. | 339/82 |
| 4,708,413 | 11/1987 | Schroeder | 439/352 |
| 4,711,511 | 12/1987 | Noorily | 439/347 |
| 4,946,395 | 8/1990 | Cope et al. | 439/352 |
| 5,234,356 | 8/1993 | Maejima et al. | 439/352 |
| 5,236,373 | 8/1993 | Kennedy | 439/347 |
| 5,257,944 | 11/1993 | Kennedy | 439/347 |

*Primary Examiner*—P. Austin Bradley
*Assistant Examiner*—Yong Kim
*Attorney, Agent, or Firm*—A. A. Tirva

[57] ABSTRACT

A connector position assurance system is provided for an electrical connector adapted to mate with another mateable connecting device. The connector includes a housing, and a primary locking arm is mounted on the housing for movement between a first position when the connector is fully mated with the mateable connecting device and second position of incomplete mating of the connector with the device. The primary locking arm includes a latch for mechanically interlocking with a cooperating latch of the mateable connecting device. A locking slider is mounted directly on the primary locking arm. The slider is slidable on the locking arm between a first position allowing movement of the locking arm and mating of the connector and the device, and a second position blocking movement of the locking arm from its second position with the connector and the device fully mated. The locking arm, in its second position, blocks movement of the locking slider from its first position to its second position and thereby indicates that the connector and the device are not fully mated.

14 Claims, 4 Drawing Sheets

ELECTRICAL CONNECTOR POSITION ASSURANCE SYSTEM

FIELD OF THE INVENTION

This invention generally relates to the art of electrical connectors and, particularly, to a connector position assurance system for an electrical connector adapted to mate with another mateable connecting device.

BACKGROUND OF THE INVENTION

Electrical connectors normally require secure mechanical and electrical engagement between one electrical connector and a mateable electrical connector or other mateable connecting device. Various latching systems have been used with electrical connectors to provide such secure engagement. Such systems usually provide this secure engagement with ease of attachment and detachment. For instance, latching mechanisms have been developed which include pivotally supported latching arms that interlock with each other or that interlock with a complementary latching mechanism of the mateable connector or connecting device.

In addition, connector position assurance devices also are known in the art. Typically, the primary function of such devices is to verify that the connectors are fully mated and latched, i.e. that the latching mechanisms are fully or securely engaged. A secondary function often is to prevent the latching mechanisms from inadvertently unlatching and permitting the connectors to separate. These connector position assurance functions may be accomplished in a variety of ways, but most prior art connector position assurance systems employ a spacer that cannot be inserted into its intended position unless the latching arm is fully engaged, and the latching arm cannot be moved when the spacer is properly positioned. Problems often are encountered with such removable spacers because they may be lost or misplaced. Therefore, in some position assurance systems, the spacers may be preloaded on the connector housing so that they cannot be lost or misplaced. However, one of the problems with such systems is that, should the preloaded spacer be inadvertently moved to its final locking position before the connectors are mated, mating cannot take place.

Still further, the latching arms of many connectors are pivotally mounted on the connector housings and, often, require a relatively long lever arm portion to pivot the latching arm to either engage or disengage the arm from a latch on the mateable connecting device. This requires considerable space on the connector assembly.

The present invention is directed to solving these problems and satisfying a need for an improved connector position assurance system.

SUMMARY OF THE INVENTION

An object, therefore, of the invention is to provide a new and improved connector position assurance system for an electrical connector adapted to mate with another mateable connecting device.

In the exemplary embodiment of the invention, an electrical connector includes a housing, and a primary locking arm is mounted on the housing for movement between a first position when the connector is fully mated with the mateable connecting device and a second position of incomplete mating of the connector with the device. The primary locking arm includes a latch for mechanically interlocking with a cooperating latch of the mateable connecting device.

The invention contemplates the provision of a locking slider mounted directly on the primary locking arm. The locking slider is slidable on the arm between a first position allowing movement of the locking arm and mating of the connector and the mateable connecting device, and a second position blocking movement of the locking arm away from its first position with the connector and the device fully mated. The locking arm, in its second position of incomplete mating of the connector with the device, blocks movement of the locking slider from its first position to its second position, thereby indicating that the connector and the device are not fully mated.

As disclosed herein, the primary locking arm is pivotally mounted on the connector housing and includes an actuating lever portion. The locking slider, at least in its first position, provides an extension of the actuating lever portion to facilitate pivoting of the locking arm. In particular, the primary locking arm is pivotally mounted intermediate opposite ends thereof. The latch is located at one end of the arm and the actuating lever portion at the other end of the arm. Preferably, the housing is fabricated of molded plastic material, and an integral living hinge means pivotally mounts the primary locking arm to the housing.

Another feature of the invention is the provision of abutment means on the mateable connecting device for engaging the locking slider and moving the slider from its second position to its first position in response to mating of the connector with the mateable connecting device in the event that the locking slider inadvertently is moved to its second position prior to mating of the connector with the device. As disclosed herein, the locking slider includes a latch for mechanically interlocking with a cooperating latch of the mateable connecting device to hold the locking slider in its second position. The abutment means is effective to engage the latch for moving the locking slider from its second position to its first position in response to mating of the connector with the device.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
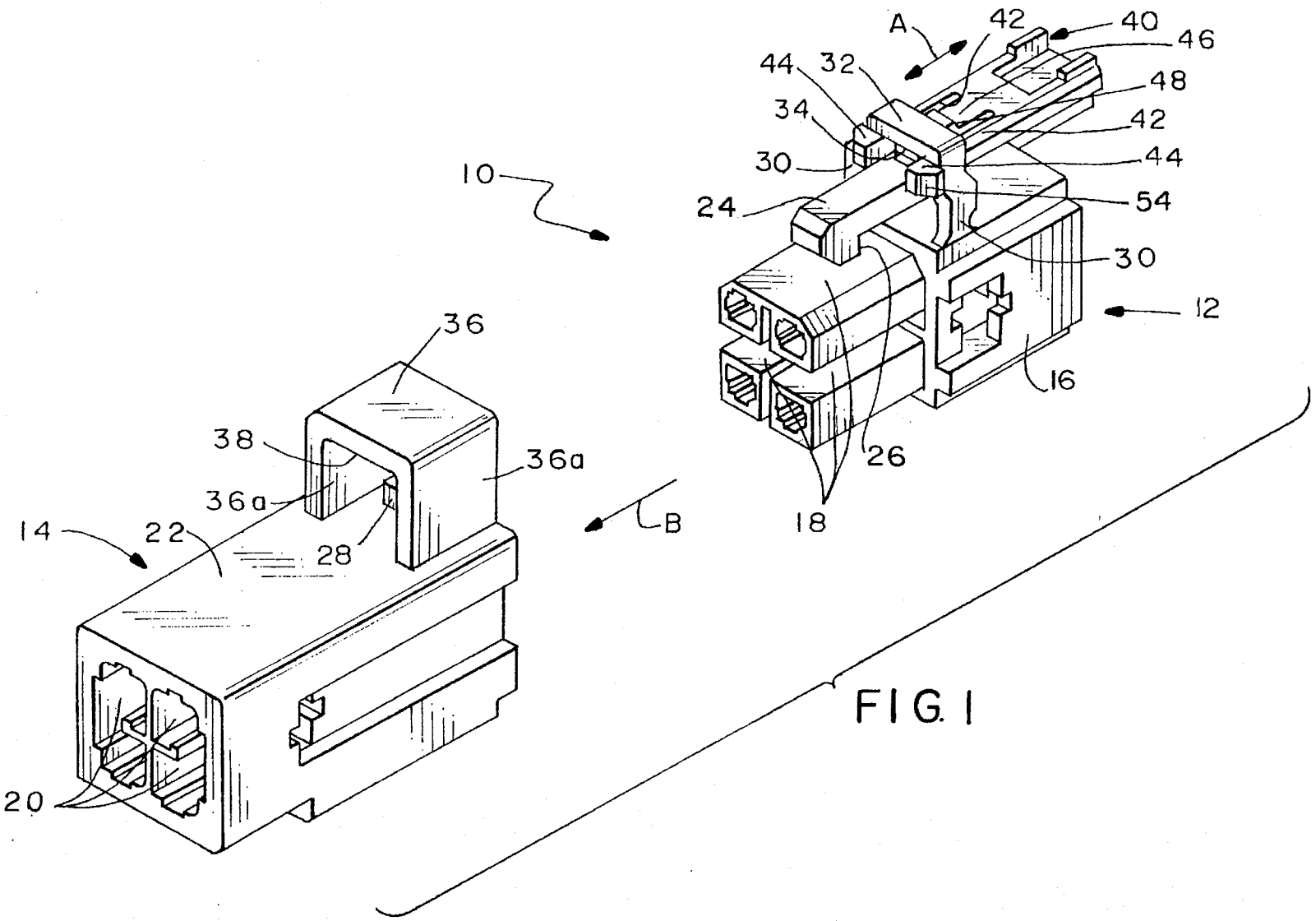
FIG. 1 is a perspective view of a pair of mateable connectors incorporating the connector position assurance system of the invention, with the connectors in unmated condition.
Figures 2, 7:
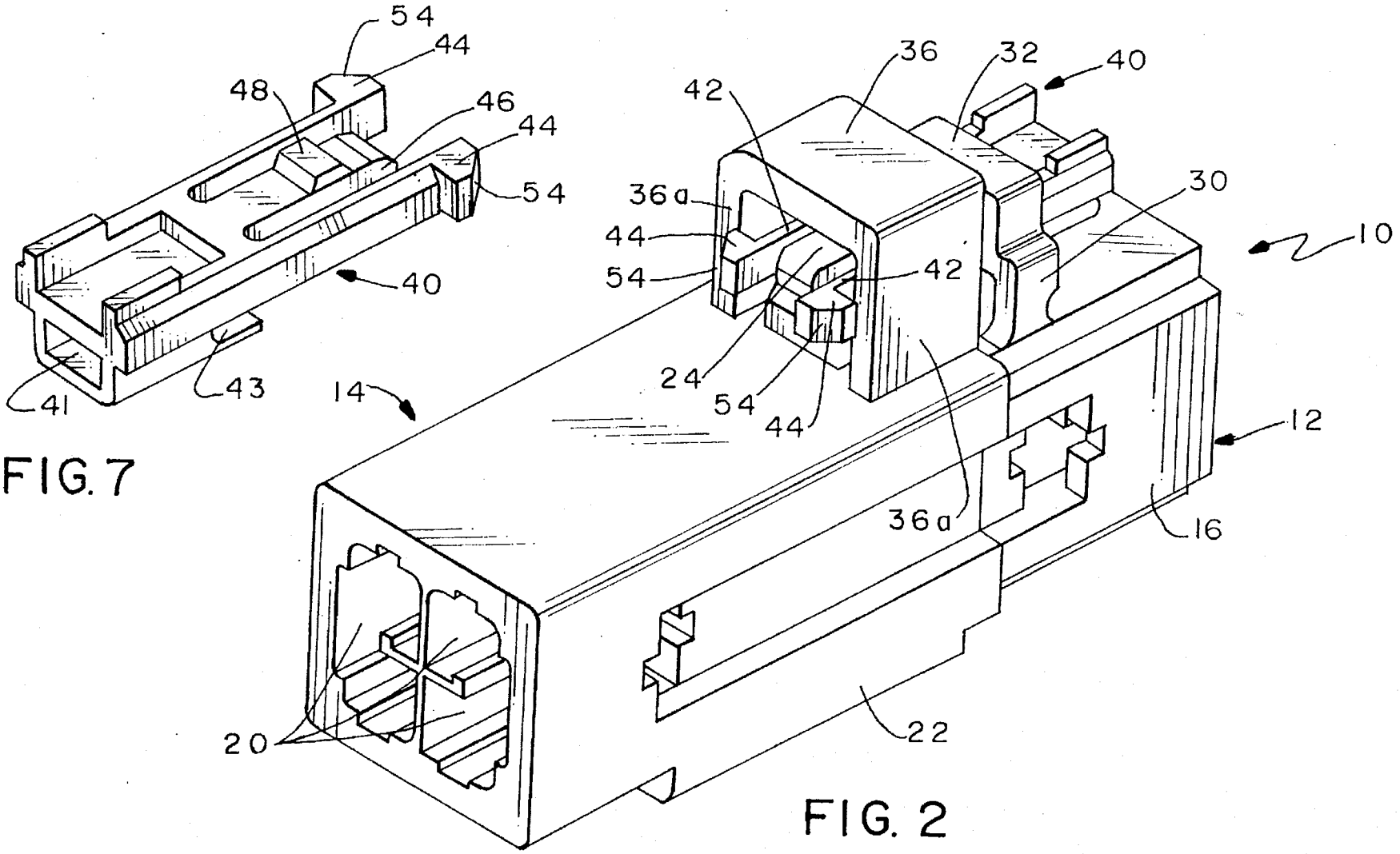
FIG. 2 is a perspective view of the connectors in fully mated condition.
FIG. 7 is a perspective view of the locking slider.

Referring to the drawings in greater detail, and first to FIGS. 1 and 2, the connector position assurance system of the invention is embodied in an electrical connector assembly, generally designated 10, which includes a first or primary connector, generally designated 12, which is adapted to mate with another mateable connecting device or second connector, generally designated 14. Primary connector 12 includes a unitarily molded dielectric housing 16 which mounts terminal means (not shown) within a plurality of silos 18 that are insertable into terminal-receiving passages 20 of a unitarily molded dielectric housing 22 of mateable connector 14.

A primary locking arm 24 is mounted on housing 16 of connector 12 and includes a latch 26 for mechanically interlocking with a cooperating latch 28 on the top of housing 22 of mateable connector 14. Primary locking arm 24 actually is pivotally mounted to connector housing 16 by a pair of pivot arms 30 molded integrally with housing 16 to define a living hinge means pivotally mounting the locking arm to the housing. A bridge 32 projects upwardly from pivot arms 30 and is spaced above locking arm 24 to define a passage 34 therebeneath. Similarly, a larger bridge 36 extends upwardly from housing 22 of connector 14 to define a passage 38 therewithin and above cooperating latch 28. A pair of legs **36*a* depend from bridge 36 and are molded integrally with connector housing 22**.

Figure 3:
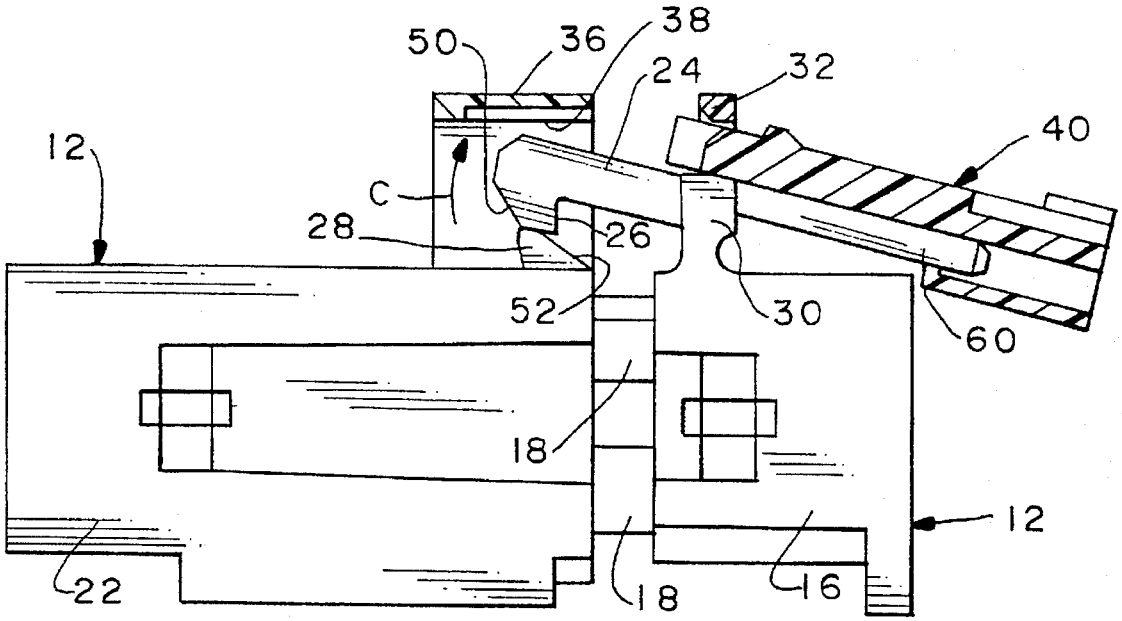
FIG. 3 is a side elevational view, partially in section, of the connectors in a condition of incomplete mating and with the locking slider in its first position.
Figure 4:
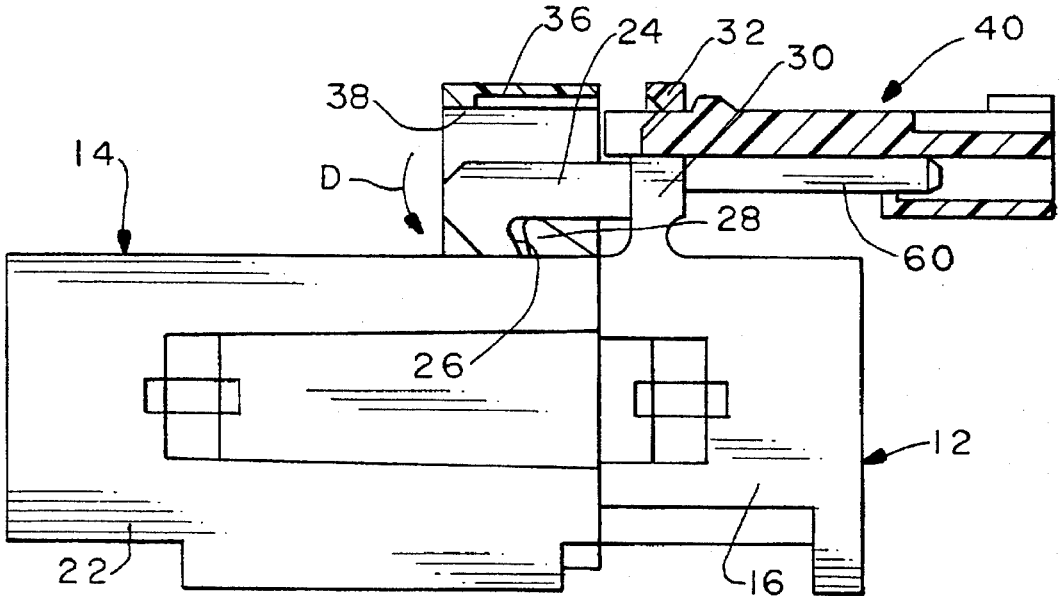
FIG. 4 is a view similar to that of FIG. 3, but with the connectors fully mated and the locking slider still in its first position.

Referring to FIGS. 3, 4 and 7 in conjunction with FIGS. 1 and 2, a locking slider, generally designated 40, is slidably mounted directly onto the top of primary locking arm 24. An opening 41 extends through a position of the locking slider 40. The opening has dimensions to slidably accommodate the locking arm 24. The locking slider can slide on the arm forwardly from the position shown in FIGS. 1, 3 and 4, and back again, in the direction of double-headed arrow "A" (FIG. 1). The locking slider is mounted in a preloaded condition on top of the locking arm 24 so that the slider cannot be lost or misplaced. This preloaded position is defined by a pair of laterally flexible latch arms 42 having laterally outwardly projecting latches 44 that engage one side of bridge 32, along with a central tongue 46 that has a latch 48 for engaging the opposite side of the bridge. While the described preloaded position is desirable because it substantially immobilizes the slider 40 on the locking arm 24, the slider may be allowed to float on the locking arm by eliminating latch 48 allowing the slider to move between the position defined by latches 44 that engage one side of bridge 32 and a U-shaped portion 43 of the slider that engages the opposite lower side of the bridge.

Figure 5:
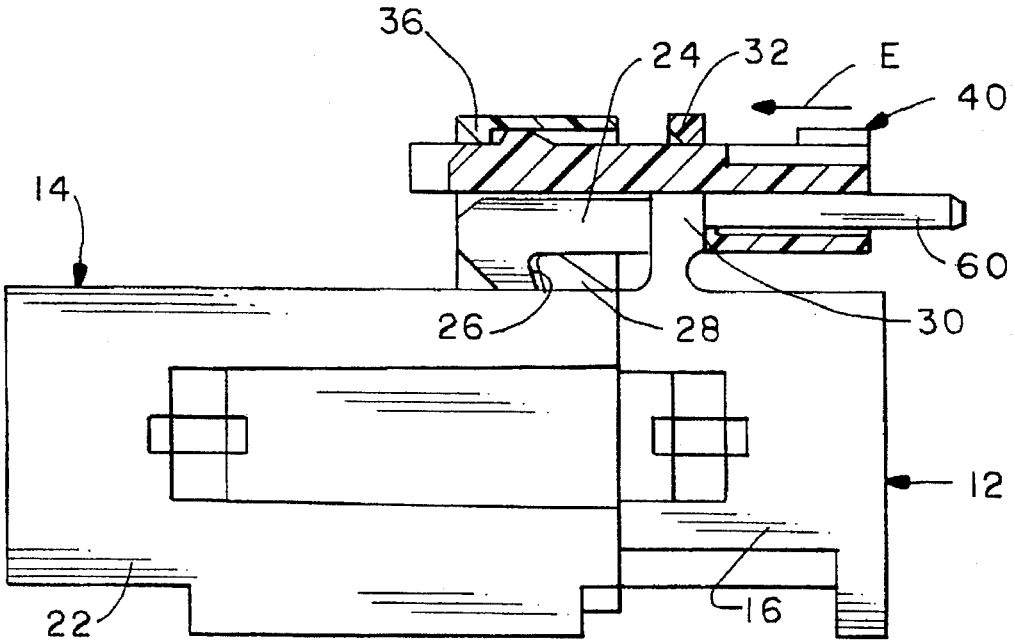
FIG. 5 is a view similar to that of FIG. 4, but with the locking slider moved to its second position blocking movement of the locking arm.

Before proceeding with a detailed description of the operation of the connector position assurance system of the invention, a general explanation of the operation first will be described. More particularly, primary locking arm 24 on primary connector 12 is pivotally movable from an inoperative position shown in FIG. 1 through a position of incomplete mating shown in FIG. 3 to a final position wherein the connectors are fully mated as shown in FIGS 2, 4 and 5. In the final, fully mated position of the primary locking arm, its latch 26 is mechanically interlocked with cooperating latch 28 of mateable connector 14 as seen best in FIGS. 4 and 5. In addition, locking slider 40 is slidably movable on primary locking arm 24 between a first position shown in FIGS. 1 and 4 allowing movement of the locking arm and mating of the connectors, and a second position shown in FIG. 5 blocking movement of the locking arm away from its final position with the connectors fully mated. Lastly, if the primary locking arm is in a position of incomplete mating as shown in FIG. 3, the locking arm blocks movement of the locking slider from its first to its second position, thereby indicating that the connectors are not fully mated.

More particularly, primary connector 12 is mated with mateable connector 14 in the direction of arrow "B" (FIG. 1). During mating, a chamfered lower edge 50 (FIG. 3) at the forward distal end of primary locking arm 24 engages a chamfered surface 52 of cooperating latch 28 on connector 14 to biasingly pivot the locking arm upwardly in the direction of arrow "C" (FIG. 3).

As the connectors are moved to their fully mated condition, primary locking arm 24 will snap back downwardly in the direction of arrow "D" shown in FIG. 4, such that latch 26 on the locking arm mechanically interlocks with cooperating latch 28 of mateable connector 14. Through this mating operation and movement of primary locking arm 24, locking slider 40 remains in its first or inoperative position shown in FIGS. 1, 3 and 4.

Once the connectors are fully mated, locking slider 40 is moved forwardly in the direction of arrow "E" shown in FIG. 5. The front end of the locking slider will move through bridge 36 of mateable connector 14 above primary locking arm 24. As clearly seen in FIG. 5, the locking slider in this second position blocks movement of locking arm 24 from its position of interlocking with cooperating latch 28 on mateable connector 14. In other words, the front end of the locking slider is sandwiched between the primary locking arm and the top of bridge 36, as shown. The locking slider is held in its second position by the interengagement of latches 44 on the front ends of latch arms 42 with depending legs **36*a* of bridge 36 and the U-shaped slider portion 43 engaging lower portion of bridge 32. During movement of the locking slider from its inoperative position to its final blocking position, chamfered surfaces 54 (FIGS. 1 and 2) at the distal ends of latch arms 42 engage depending legs 36*a* of bridge 36 and bias latch arms 42** inwardly so that the arms pass through the bridge and then snap back outwardly to their latching positions.

As stated above, should the connectors be in a condition of incomplete mating, locking slider 40 is blocked from moving to its final or second position, thereby indicating that the connectors are not fully mated. This condition is shown in FIG. 3. Specifically, it can be seen that the connectors are not sufficiently mated such that latch 26 on primary locking arm 24 has not moved past latch 28 on mateable connector 14. In this condition of incomplete mating, it can be seen that the locking arm is in an elevated position and blocks passage of locking slider 40 through passage 38 within bridge 36. Since the locking slider cannot move forwardly, a clear indication is given that the connectors are not fully mated.

Figure 6:
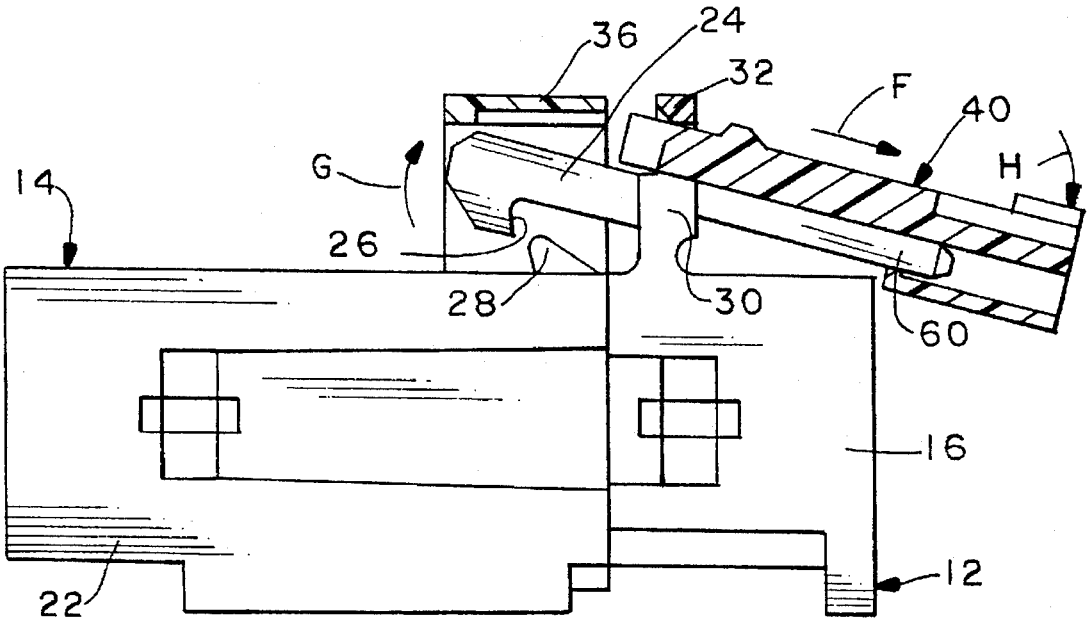
FIG. 6 is a view similar to that of FIG. 4, but showing the locking arm pivoted to allow unmating of the connectors.

Lastly, FIG. 6 shows another feature of the invention wherein locking slider 40 is advantageously used as a lever means to actuate primary locking arm 24, particularly in facilitating unmating of the connectors. More particularly, FIG. 6 shows that locking slider 40 has been moved back to its initial preloaded position and no longer blocks pivotal movement of the locking arm within bridge 36 of mateable connector 14. The locking arm now can be pivoted in the direction of arrow "G" to disengage the mechanical interlocking of latch 26 on the locking arm with latch 28 on the mateable connector. This will allow unmating of the connectors. In order to facilitate pivoting of the primary locking arm, an actuating lever portion 60 extends from locking arm 24 on the opposite side of pivot 30. However, with miniature connectors, in order to provide a sufficiently long actuating lever portion, the lever portion would have to extend unnecessarily beyond the rear of connector housing 16. It can be seen that locking slider 40, in its inoperative position, provides an extension of lever portion 60 so that downward pressure can be applied to the locking slider in the direction of arrow "H" to pivot locking arm 24 upwardly in the direction of arrow "G". Once the locking slider is moved to its final blocking position shown in FIG. 5, it can be seen that the locking slider does not project rearwardly beyond the connector housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A connector position assurance system for an electrical connector adapted to mate with another mateable connecting device, comprising:

said connector including a housing;

a primary locking arm on the housing for movement between a first position when the connector is fully mated with the mateable connecting device and a second position of incomplete mating of the connector with the device, the primary locking arm including a latch for mechanically interlocking with a cooperating latch of the mateable connecting device;

a locking slider mounted directly on the primary locking arm with said locking arm interposed between said locking slider and said housing, said locking slider being slidable on said locking arm between a first position allowing movement of said locking arm and mating of the connector and the device and a second position blocking movement of the locking arm away from its first position with the connector and the device fully mated; and said primary locking arm in its second position of incomplete mating of the connector with the device said arm blocking movement of the locking slider from its first position to its second position and thereby indicating that the connector and the device are not fully mated.

2. The connector position assurance system of claim 1 wherein said primary locking arm includes an actuating portion, and said locking slider, at least in its first position, is coupled to the primary locking arm for providing an extension of the actuating portion.

3. The connector position assurance system of claim 1 wherein said primary locking arm is pivotally mounted on the housing.

4. The connector position assurance system of claim 3 wherein said locking slider, at least in its first position, is located to provide a lever means for the primary locking arm.

5. The connector position assurance system of claim 3 wherein said primary locking arm includes an actuating lever portion, and said locking slider, at least in its first position, is coupled to the primary locking arm for providing an extension of the actuating lever portion.

6. The connector position assurance system of claim 3 wherein said latch is located on the primary locking arm in a position for pivotal movement in an arc transverse to the sliding movement of said locking slider.

7. The connector position assurance system of claim 6 wherein said primary locking arm is pivotally mounted intermediate opposite ends thereof, with said latch being at one end of the locking arm and including an actuating lever portion at the other end of the locking arm.

8. The connector position assurance system of claim 7 wherein said locking slider, at least in its first position, is located to provide an extension of the actuating lever portion of the locking arm.

9. The connector position assurance system of claim 7 wherein said housing is fabricated of molded plastic material, and including an integral living hinge means pivotally mounting the primary locking arm to the housing.

10. The connector position assurance system of claim 1 wherein said locking slider includes a latch for mechanically interlocking with a cooperating latch of the mateable connecting device to hold the locking slider in its second position.

11. The connector position assurance system of claim 1, including abutment means on the mateable connecting device for engaging the locking slider and moving the locking slider from its second position to its first position in response to mating of the connector with the device in the event that the locking slider inadvertently is in its second position prior to mating of the connector with the device.

12. The connector position assurance system of claim 11 wherein said locking slider includes a latch for mechanically interlocking with a cooperating latch of the mateable connecting device to hold the locking slider in its second position, said abutment means being located in the path of the latch on the locking slider for moving the locking slider from its second position to its first position.

13. A connector position assurance system for an electrical connector adapted to mate with another mateable connecting device, comprising:

said connector including a housing;

a primary locking arm on the housing for movement between a first position when the connector is fully mated with the mateable connecting device and a second position of incomplete mating of the connector with the device, the primary locking arm including a latch for mechanically interlocking with a cooperating latch of the mateable connecting device;

a locking slider mounted on the connector and being slidable between a first position allowing movement of said locking arm and mating of the connector and the device and a second position blocking movement of the locking arm away from its first position with the connector and the device fully mated;

said primary locking arm in its second position of incomplete mating of the connector with the device blocking movement of the locking slider from its first position to its second position and thereby indicating that the connector and the device are not fully mated; and abutment means on the mateable connecting device for engaging the locking slider and moving the locking slider from its second position to its first position in response to mating of the connector with the device in the event that the locking slider inadvertently is in its second position prior to mating of the connector with the device.

14. The connector position assurance system of claim 13 wherein said locking slider includes a latch for mechanically interlocking with a cooperating latch of the mateable connecting device to hold the locking slider in its second position, said abutment means being located in the path of the latch on the locking slider for moving the locking slider from its second position to its first position.

* * * * *